US009416514B2

(12) United States Patent
Niekamp et al.

(10) Patent No.: US 9,416,514 B2
(45) Date of Patent: Aug. 16, 2016

(54) POST DRIVER WITH LIMITED MOVEMENT FLOATING POST ANVIL

(71) Applicant: Danuser LLC, Fulton, MO (US)

(72) Inventors: Gary J Niekamp, Jefferson City, MO (US); Tyler Van Lant, Columbia, MO (US)

(73) Assignee: DANUSER LLC, Fulton, MO (US)

( * ) Notice: Subject to any disclaimer, the term of this patent is extended or adjusted under 35 U.S.C. 154(b) by 661 days.

(21) Appl. No.: 13/753,266

(22) Filed: Jan. 29, 2013

(65) Prior Publication Data

US 2013/0140053 A1 Jun. 6, 2013

(51) Int. Cl.

| | |
|---|---|
| ***B23B 45/16*** | (2006.01) |
| ***B25D 11/00*** | (2006.01) |
| ***B25D 9/00*** | (2006.01) |
| ***B25D 13/00*** | (2006.01) |
| ***B25D 16/00*** | (2006.01) |
| ***E21B 1/00*** | (2006.01) |
| ***E02D 7/08*** | (2006.01) |

(52) U.S. Cl.

CPC ..... *E02D 7/08* (2013.01)

(58) Field of Classification Search

CPC ..... E02D 7/08; E21B 28/00; E04H 17/26; B23Q 3/00; B25D 17/08; B25D 9/00; B25D 15/00

USPC ..... 173/93, 115, 128–129, 133, 137

See application file for complete search history.

(56) References Cited

U.S. PATENT DOCUMENTS

| | | | | |
|---|---|---|---|---|
| 1,102,652 | A * | 7/1914 | Gibb et al. | 173/91 |
| 3,313,356 | A * | 4/1967 | Clevenger | E04H 17/263 144/195.5 |
| 3,735,822 | A * | 5/1973 | Deike | B25D 1/16 144/195.5 |
| 3,744,578 | A * | 7/1973 | Lisenby | E21B 7/00 173/19 |
| 3,837,409 | A * | 9/1974 | Consoli et al. | 173/48 |
| 3,869,003 | A * | 3/1975 | Yamada et al. | 175/171 |
| 3,871,528 | A * | 3/1975 | Wilkinson | 212/278 |
| 3,887,018 | A * | 6/1975 | Jayne | 173/120 |
| 4,102,408 | A * | 7/1978 | Ludvigson | E02D 7/08 173/125 |
| 4,139,067 | A * | 2/1979 | Craig | 173/100 |
| 4,384,668 | A * | 5/1983 | Tutomu et al. | 227/8 |

(Continued)

OTHER PUBLICATIONS

Danuser Hammer advertisement from Compact Equipment magazine, published Apr. 2012, p. 25.

(Continued)

*Primary Examiner* — Robert Long

(74) *Attorney, Agent, or Firm* — Husch Blackwell LLP

(57) ABSTRACT

The post driver with limited movement floating post anvil does not rely heavily upon the skill of the operator to efficiently drive posts. The post anvil is allowed to move up and down in relation to the driver, but its movement is limited by both lower and upper fixed barriers. Since the movement is limited, the operator can position the driver upon the post allowing the full weight of the driver framework/carrier machine to rest upon the post. The post would push the floating post anvil upward only to the point at which the upper fixed barrier prevents further upward movement of the floating post anvil. Thus, once the floating post anvil abuts the upper fixed barrier, substantially the entire weight of the post driver is resting on the post.

10 Claims, 2 Drawing Sheets

(56) References Cited

U.S. PATENT DOCUMENTS

| | | | | |
|---|---|---|---|---|
| 4,446,930 | A * | 5/1984 | Nilsson et al. | 173/29 |
| 4,624,325 | A * | 11/1986 | Steiner | F16F 9/516 173/133 |
| 4,844,661 | A * | 7/1989 | Martin | E02D 7/06 173/81 |
| 4,938,297 | A * | 7/1990 | Schmidt | 175/19 |
| 5,449,253 | A * | 9/1995 | Roger | E02D 7/28 405/232 |
| 5,934,162 | A * | 8/1999 | Habermehl | 81/434 |
| 6,105,683 | A | 8/2000 | Thiessen | |
| 6,315,059 | B1 * | 11/2001 | Geldean | 173/31 |
| 6,347,672 | B1 * | 2/2002 | Reardon | E04H 17/263 173/132 |
| 6,508,315 | B1 * | 1/2003 | Lindsay | 173/115 |
| 6,702,037 | B1 | 3/2004 | Thiessen | |
| 6,776,242 | B1 * | 8/2004 | Cunningham | E04H 17/263 173/124 |
| 6,997,269 | B1 * | 2/2006 | Putney | 173/29 |
| 7,018,257 | B2 * | 3/2006 | Courtney | 441/93 |
| 7,387,173 | B2 * | 6/2008 | Jinnings | E02D 7/10 173/147 |
| 7,703,640 | B1 * | 4/2010 | Hollars et al. | 222/5 |
| 2003/0178212 | A1 * | 9/2003 | Dennis | E04H 17/263 173/89 |
| 2004/0003932 | A1 * | 1/2004 | Jubinville | E04H 12/2215 173/91 |
| 2004/0154812 | A1 * | 8/2004 | McDonald | E04H 17/263 173/90 |
| 2006/0213676 | A1 * | 9/2006 | Jinnings et al. | 173/184 |
| 2006/0260829 | A1 * | 11/2006 | Kleinert | E04H 17/263 173/91 |
| 2007/0017684 | A1 * | 1/2007 | Stirm et al. | 173/109 |
| 2007/0039748 | A1 * | 2/2007 | Kennett | 173/117 |
| 2009/0088304 | A1 * | 4/2009 | Washington | 482/128 |
| 2010/0024611 | A1 * | 2/2010 | Starick et al. | 81/470 |
| 2010/0025061 | A1 * | 2/2010 | Meixner et al. | 173/118 |
| 2010/0212922 | A1 * | 8/2010 | White | E02D 7/08 173/1 |
| 2010/0236802 | A1 * | 9/2010 | Berger et al. | 173/118 |
| 2011/0139475 | A1 * | 6/2011 | Braun et al. | 173/112 |
| 2011/0162859 | A1 * | 7/2011 | White | E02D 7/125 173/1 |
| 2011/0180284 | A1 * | 7/2011 | Carrier et al. | 173/1 |
| 2011/0240321 | A1 * | 10/2011 | Palmlund et al. | 173/90 |
| 2013/0140052 | A1 * | 6/2013 | Niekamp | E02D 7/08 173/81 |
| 2013/0255985 | A1 * | 10/2013 | Zakuskin | 173/209 |
| 2014/0208575 | A1 * | 7/2014 | Jagdale et al. | 29/525.02 |
| 2014/0262399 | A1 * | 9/2014 | Cunningham | 173/133 |
| 2015/0217419 | A1 * | 8/2015 | Whitmer | E04H 17/263 173/178 |

OTHER PUBLICATIONS

Images of Anti-Dry Fire Mechanism, Jul. 24, 2012.
Danuser Postmaster brochure, at least as early as Aug. 8, 2007.
Danuser Hammer SM40, Operator's Manual, Jul. 10, 2012.
Danuser Hammer brochure, at least as early as Feb. 7, 2012.
Quick Attach Attachments, Inc. Quick Sledge brochure, at least as early as 2011.
Bradco PD4800 Post Driver, Operator's and Parts Manual, published Aug. 16, 2005, pp. 4-6.
Bradco PD4800 Post Driver, Operator's and Parts Manual, published Aug. 20, 2005, p. 3.
Bradco PD4800 Post Driver, Operator's and Parts Manual, published Sep. 28, 2005, p. 25.
Bradco PD4800 Post Driver, Operator's and Parts Manual, published Mar. 20, 2008, p. 23.
Bradco PD4800 Post Driver, Operators and Parts Manual, published Jul. 9, 2008, pp. 26-29.
Bradco PD4800 Post Driver, Operators and Parts Manual, published Jul. 10, 2008, pp. 7, 8, 10-13, and 16.
Bradco PD4800 Post Driver, Operators and Parts Manual, published Jul. 14, 2008, p. 14.
Bradco PD4800 Post Driver, Operators and Parts Manual, published Jul. 21, 2008, pp. 17-20.
Bradco PD4800 Post Driver, Operators and Parts Manual, published Jul. 22, 2008, p. 40.
Bradco PD4800 Post Driver, Operators and Parts Manual, published Jul. 23, 2008, pp. 9, 30-39, and 41.
Bradco PD4800 Post Driver, Operators and Parts Manual, published Jul. 24, 2008, pp. 1, 15, 21, 22, 24, 42-43.
Bradco PD4800 Post Driver, Operators and Parts Manual, published Aug. 8, 2008, cover page.

* cited by examiner

POST DRIVER WITH LIMITED MOVEMENT FLOATING POST ANVIL

CROSS-REFERENCE TO RELATED APPLICATIONS

No related application.

BACKGROUND OF THE DISCLOSURE

1. Field of Disclosure

This disclosure relates generally to a post driver with a floating post anvil, and more particularly, to a post driver with a floating post anvil that has limited movement to facilitate ease of operation and maximize the amount of available energy to be applied to the post driving process.

2. Background Art

Post Drivers that utilize the pile driving principle of raising a weight to some distance above a post and then dropping the weight in order to drive the post rely heavily upon the skill of the operator to properly position the post driver at the correct height before every cycle of the driver. Such post drivers rely on a post being present to dissipate the energy of the falling weight. When a post is properly positioned within the post driver, the kinetic energy of the falling weight is transferred into the post, pushing it into the ground. However, when a post is not properly positioned within the post driver, the weight may fail to contact the post upon falling, and may instead impact upon the frame of the post driver. Such a so-called "dry fire" can damage the post driver apparatus.

Many post drivers all work on the pile driving principle of raising a weight to some distance above a post and then dropping the weight in order to drive the post. Some such drivers utilize a floating post anvil that rests on the top of the post and is allowed to move up or down in relation to the vertical position of the driver. The anvil is designed to protect the post so that the post is not damaged by the falling weight. Generally, the post is positioned within the post driver such that the anvil rests on top of the post. When the weight falls, it impacts the anvil rather than directly striking the post. The kinetic energy is still transferred into the post, pushing it into the ground, but through the intermediary of the anvil so as to protect the post. This type of design relies heavily upon the skill of the operator to properly position the post driver at the correct height. If the driver is positioned too high and the anvil is not in contact with the post and/or is already resting at the bottom of the post driver frame, a dry firing situation may occur, causing damage to the driver. If the driver is positioned too low such that the post extends too far up into the post driver, the overall driving performance is diminished due to the shorter stroke length.

Further, during the operation of the post driver, the operator must lower the driver as the post is driven into the ground in order to prevent dry firing of the driver. This lowering of the driver can be a difficult process depending upon the skill of the operator thus increasing the time required to drive a post. It is common for the driver to be lowered too far which greatly reduces the performance of the driver due to the shorter distance the weight is dropped. Thus, a driver with limited movement floating post anvil would solve these issues.

BRIEF SUMMARY OF DISCLOSURE

The post driver with limited movement floating post anvil does not rely heavily upon the skill of the operator to efficiently drive posts. The post anvil is allowed to move up and down in relation to the driver, but its movement is limited by both lower and upper fixed barriers. Since the movement is limited, the operator can position the driver upon the post allowing the full weight of the driver framework/carrier machine to rest upon the post. The post would push the floating post anvil upward only to the point at which the upper fixed barrier prevents further upward movement of the floating post anvil. Thus, once the floating post anvil abuts the upper fixed barrier, substantially the entire weight of the post driver is resting on the post. This added weight put on the post increases driving force and prevents the post from "walking" around during driving. Due to the limited movement of the post anvil, the operator can place the carrier machine into the hydraulic float position and the driver will follow the post as it is driven into the ground without the operator needing to lower the driver to prevent dry firing. The limited movement of the post anvil also allows the weight to be dropped the maximum allowable distance every cycle thus maximizing the post driver's performance.

Accordingly, an aspect of the present disclosure is a post driver comprising a weight with a protrusion member, a fixed upper barrier with an opening for the protrusion member of the weight, a floating anvil that sits on a post, wherein movement of the floating anvil is limited, and a fixed lower barrier with an aperture for an insertion of the post.

BRIEF DESCRIPTIONS OF THE DRAWINGS

For a better understanding of the present disclosure, reference may be made to the accompanying drawings in which.

Figure 2:
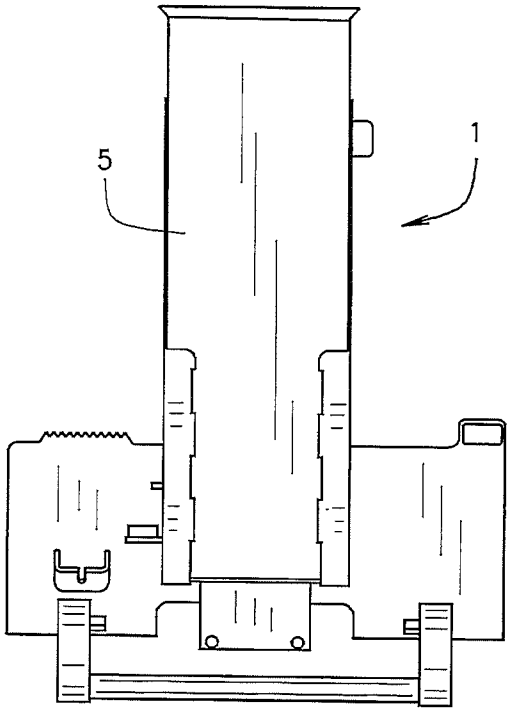
FIG. 2 is a front-side illustration of a post driver.

While the disclosure is susceptible to various modifications and alternative forms, specific embodiments thereof are shown by way of example in the drawing and will herein be described in detail. It should be understood, however, that the drawings and detailed description presented herein are not intended to limit the disclosure to the particular embodiment disclosed, but on the contrary, the intention is to cover all modifications, equivalents, and alternatives falling within the spirit and scope of the present disclosure as defined by the appended claims.

DETAILED DESCRIPTIONS OF THE DISCLOSURE

Figure 1:
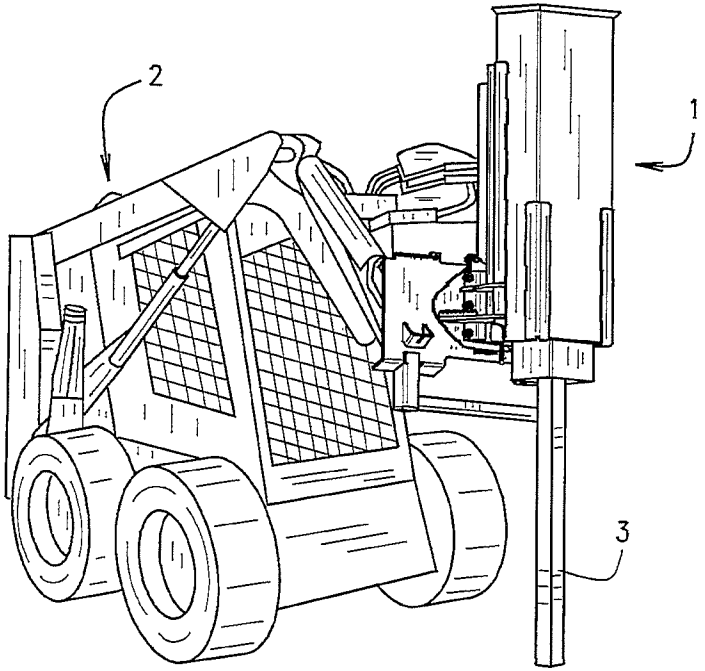
FIG. 1 is an illustration of a post driver mounted in front of a mobile vehicle or equipment, such as a skid-steer.

Referring to FIG. 1, an embodiment of the present post driver 1 is shown as connected to a skid-steer loader 2, in position to drive a post 3 into the ground. Post driver 1 may instead be adapted for attachment to and operation via a front-end loader or any other suitable vehicle. As shown in FIG. 2, post driver 1 includes an outer housing 5 which contains the internal workings of the post driver 1.

Figure 3:
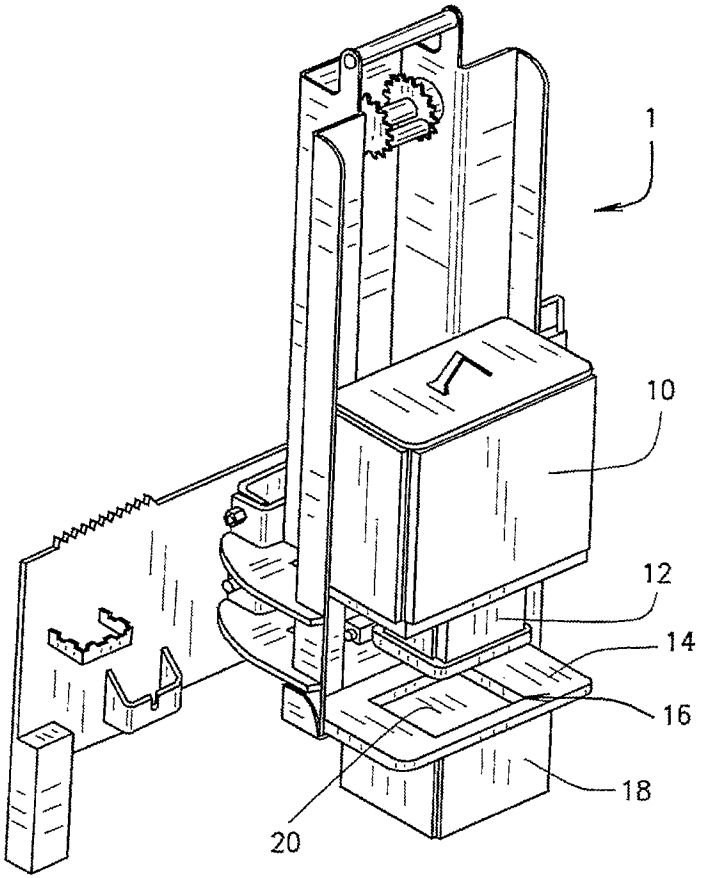
FIG. 3 is an oblique illustration of a post driver.

As shown in FIG. 3, the internal workings of post driver 1 include a weight (or hammer) 10 with a protrusion member 12 extending from the bottom thereof. The weight 10 and protrusion member 12 are preferably comprised of a heavy, durable material as would be known to one of ordinary skill in the art. Below the weight 10 is positioned a fixed upper barrier 14 which includes a through hole 16. Hole 16 is sized and shaped to allow the protrusion member 12 of the weight 10 to pass therethrough when the weight 10 is allowed to fall for each stroke of the post driver 1. Preferably, the protrusion member 12 is long enough to impact substantially all of the kinetic energy from the falling weight 10 into the post 3 before the weight 10 impacts the fixed upper barrier 14.

Residing below the fixed upper barrier 14 and within a guide 18 is a floating anvil 20. Floating anvil 20 is designed to be positioned between the weight 10 and the post 3 during operation of the post driver 1. When the weight 10 falls, the protrusion member 12 falls through the hole 16 in fixed upper barrier 14, and strikes the floating anvil 20. In normal operation, floating anvil 20 would be positioned so as to rest on top of a post 3, such that the kinetic energy from the weight 10 and protrusion member 12 pass through the floating anvil 20 and into the post 3. This protects the post 3 from damage from the falling weight 10, but still drives the post 3 into the ground. For this reason, floating anvil 20 is preferably comprised of a durable material as would be known to one of ordinary skill in the art. In other embodiments, the weight 10 need not include a protrusion member 12, and the hole 16 in the fixed upper barrier 14 may simply be sized to allow the striking end of the weight 10 to directly impact the floating anvil 20 therebelow.

Figure 4:
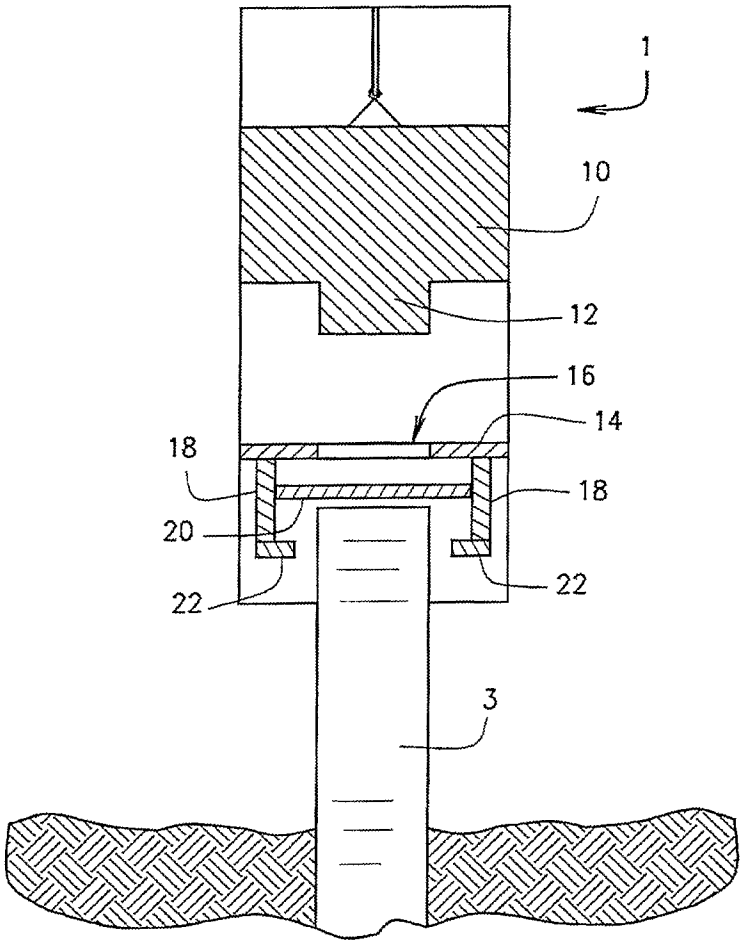
FIG. 4 is an illustration of a post driver with a floating anvil of limited movement.

As noted above, floating anvil 20 is positioned within guide 18, and is bounded on the top by the fixed upper barrier 14. Floating anvil 20 is also bounded on the bottom by fixed lower barrier 22, visible in the cross-sectional view of FIG. 4. Thus, although floating anvil 20 is allowed to float, its movement is constrained on at least the top and bottom by the fixed upper and lower barriers 14, 22. Preferably, the floating anvil 20 is also constrained against lateral movement by guide 18. The floating anvil 20, guide 18 and fixed upper and lower barriers 14, 22 form the limited anvil movement portion of the post driver 1.

In operation, the floating anvil 20 initially rests on the fixed lower barrier 22 when no post 3 is within the post driver 3. An operator places the post driver 1 over the top of a post 3, such that the top of the post 3 enters the post driver 1 via the fixed lower barrier 22. As the post 3 enters the post driver 1, it encounters the floating anvil 20, pushing the floating anvil 20 up. At this point in the process, the lowering of the post driver 1 has applied little weight to the post 3 itself, as there is little resistance to the post 3 pushing the floating anvil 20 upwardly as the post 3 enters the post driver 1. However, eventually, the floating anvil 20 moves upward to the point that it contacts the fixed upper barrier 14, at which point further upward movement of the floating anvil 20 is prevented by the fixed upper barrier 14.

Once the floating anvil 20 is pressed upwardly against the fixed upper barrier 14, any additional lowering of the post driver 1 applies additional weight on top of the post 3. The weight of the post driver 1 is now resting on top of post 3, through the floating anvil 20 and fixed upper barrier 14. This additional weight helps to drive the post 3 into the ground, and can help to keep the post 3 from "walking" or moving during the driving process.

Once the post driver 1 is properly positioned over the post 3 so as to press the floating anvil 20 into the fixed upper barrier 14, the weight 10 is dropped. The protrusion member 12 passes through the hole 16 in the fixed upper barrier 14 and impacts the floating anvil 20, which impacts the force of the falling weight 10 into the post 3, beginning to drive the post into the ground. The weight 10 is then lifted up again to prepare for another stroke of the post driver 1. At this point, the post 3 has been driven partially into the ground, such that it no longer extends as far up into the post driver 1 and no longer presses the floating anvil 20 into the fixed upper barrier 14. An operator therefore must lower the post driver 1, as before, until the top of the post 3 again presses the floating anvil 20 up into contact with the fixed upper barrier 14, so that another stroke can occur and the process can be repeated until the post 3 is sufficiently driven into the ground. In one embodiment, the operator may place the skid-steer 2 or other carrier machine into a "hydraulic float" position, in which the post driver 1 will follow the post 3 into the ground, keeping the floating anvil 20 pressed against the fixed upper barrier 14 through the process.

The fixed upper barrier 14 thereby prevents an operator from lowering the post driver 1 too far over a post 3, and thereby prevents inefficient short strokes of the weight 10. Additionally, the operator is no longer forced to guess when the post driver 1 has been lowered over the post 3 enough to prevent a dry-fire. Instead, the operator needs only to lower the post driver 1 over the post 3 until the post 3 presses the floating anvil 20 into the fixed upper barrier 14, which signals to the operator that additional lowering is unnecessary. In fact, the operator will be unable to lower the post driver 1 any farther, and attempts to lower the post driver 1 any farther will simply exert beneficial weight onto the top of the post. The fixed upper barrier 14 also assists with subsequent strokes of the weight 1, as the operator can merely continue to lower the post driver 1 so that it comes to rest on the top of the post 3 after each stroke, taking much of the difficulty out of driving posts. The post driver 1 can be lowered only to the point of a proper weight strike, and the lowering of the post driver 1 to that point is clearly indicated to the operator by the failure of the post driver 1 to lower any farther.

In one embodiment, the vertical position of the fixed upper and/or lower barriers 14, 22 may be adjustable. Similarly, the fixed upper and/or lower barriers 14, 22 may be replaceable with fixed barriers 14, 22 having differently sized thicknesses and/or through-holes 16 for differently sized weights 10 and/or protrusion members 12. The protrusion member 12 may also be replaceable bottom of weight 10.

As is evident from the foregoing description, certain aspects of the present disclosure are not limited by the particular details of the examples illustrated herein, and it is therefore contemplated that other modifications and applications, or equivalents thereof, will occur to those skilled in the art. It is accordingly intended that the claims shall cover all such modifications and applications that do not depart from the spirit and scope of the present disclosure. Moreover, unless defined otherwise, all technical and scientific terms used herein have the same meaning as commonly understood by one of ordinary skill in the art to which the disclosure belongs. Although any methods and materials similar to or equivalent to or those described herein can be used in the practice or testing of the present disclosure, the preferred methods and materials are described above. Other aspects, objects and advantages of the present disclosure can be obtained from a study of the drawings, the disclosure and the appended claims.

The invention claimed is:

1. A post driver comprising:

a weight;

a fixed upper barrier positioned below the weight, the fixed upper barrier having a through-hole extending therethrough, said hole being sized and shaped to allow at least a portion of the weight to pass at least partially therethrough;

a fixed lower barrier positioned below the fixed upper barrier, the fixed lower barrier being sized and shaped to allow a post to pass therethrough;

a floating anvil positioned entirely between the fixed upper barrier and the fixed lower barrier; and a driver body, said driver body housing said weight, fixed upper barrier, fixed lower barrier, and floating anvil therein, wherein said fixed upper barrier has a fixed position with respect to the driver body;

wherein said weight is positioned within said driver body to rise above the fixed upper barrier out of contact with the floating anvil and fall into contact with the floating anvil through the through-hole in the fixed upper barrier.

2. The post driver of claim 1 wherein the floating anvil has its upward movement limited by the fixed upper barrier.

3. The post driver of claim 1 wherein the floating anvil has its downward movement limited by the fixed lower barrier.

4. The post driver of claim 1 wherein the position of the fixed upper barrier is adjustable to be lowered or elevated relative to the length of the post driver.

5. The post driver of claim 1 wherein the fixed upper barrier is replaceable.

6. The post driver of claim 1 wherein the weight includes a protrusion member.

7. The post driver of claim 6 wherein the through-hole in the fixed upper barrier is sized and shaped to allow the protrusion member of the weight to pass at least partially therethrough.

8. The post driver of claim 6 wherein the protrusion member is replaceable.

9. The post driver of claim 1, wherein the position of the fixed lower barrier is adjustable to be lowered or elevated relative to the length of the post driver.

10. The post driver of claim 1, wherein the fixed lower barrier is replaceable.

* * * * *